US007028770B2

(12) United States Patent
Smith, Jr. et al.

(10) Patent No.: US 7,028,770 B2
(45) Date of Patent: Apr. 18, 2006

(54) TUBULAR EXPANSION APPARATUS AND METHOD

(75) Inventors: Sidney K. Smith, Jr., Conroe, TX (US); Martin P. Coronado, Cypress, TX (US); Andy Tom, Houston, TX (US); Van N. Ho, Houston, TX (US); Fatih M. Kara, Houston, TX (US)

(73) Assignee: Baker Hughes, Incorporated, Houston, TX (US)

( * ) Notice: Subject to any disclaimer, the term of this patent is extended or adjusted under 35 U.S.C. 154(b) by 10 days.

(21) Appl. No.: 10/260,139

(22) Filed: Sep. 30, 2002
(Under 37 CFR 1.47)

(65) Prior Publication Data

US 2003/0150608 A1 Aug. 14, 2003

Related U.S. Application Data

(60) Provisional application No. 60/326,364, filed on Oct. 1, 2001.

(51) Int. Cl.
*E21B 23/00* (2006.01)

(52) U.S. Cl. ..... 166/206; 166/207; 166/215; 166/277

(58) Field of Classification Search ..... 166/277, 166/384, 206, 207, 214, 215
See application file for complete search history.

(56) References Cited

U.S. PATENT DOCUMENTS 1,494,128 A * 5/1924 Primrose ..... 72/370.08
3,191,680 A 6/1965 Vincent
3,358,760 A 12/1967 Blagg
3,489,220 A * 1/1970 Kinley ..... 166/277
3,785,193 A 1/1974 Kinley et al.
4,358,961 A * 11/1982 Woods, Jr. ..... 73/827
4,487,052 A 12/1984 Yarnell
4,557,331 A * 12/1985 Stout ..... 166/297
4,602,495 A 7/1986 Yarnell
4,779,445 A * 10/1988 Rabe ..... 72/393
5,014,782 A * 5/1991 Daspit ..... 166/120
5,074,048 A * 12/1991 Yokomizo et al. ..... 33/203.13
5,513,703 A * 5/1996 Mills et al. ..... 166/55.1
5,560,624 A * 10/1996 Williams et al. ..... 279/2.03
5,785,120 A 7/1998 Smalley et al.
6,012,523 A 1/2000 Campbell et al.
6,112,818 A 9/2000 Campbell
6,142,230 A 11/2000 Smalley et al.

(Continued)

FOREIGN PATENT DOCUMENTS

JP 55057331 A * 4/1980

*Primary Examiner*—David Bagnell
*Assistant Examiner*—Shane Bomar
(74) *Attorney, Agent, or Firm*—Steve Rosenblatt

(57) ABSTRACT

Tools for expanding downhole tubulars into each other or in open hole are disclosed. One embodiment uses a movable cone biased by Bellville washers to move longitudinally against such bias and allow collets to move radially in or out to a predetermined maximum diameter. A release system allows collet retraction to avoid hang up on removal. In an alternate embodiment, more suitable for open hole applications, pressurized gas pushes a movable cone longitudinally against the collets. A stationary cone is on the opposite side of the collets from the movable cone. The collet rides out or in between the cones and raises the gas pressure when forced in. A pressure actuated release allows the lower cone to shift downwardly to allow the collets to retract for removal.

14 Claims, 2 Drawing Sheets

U.S. PATENT DOCUMENTS 6,622,789 B1 * 9/2003 Braddick ..... 166/277
6,688,397 B1 * 2/2004 McClurkin et al. ..... 166/380
2004/0159446 A1 * 8/2004 Haugen et al. ..... 166/384
2005/0022986 A1 * 2/2005 Ring et al. ..... 166/208

* cited by examiner

TUBULAR EXPANSION APPARATUS AND METHOD

PRIORITY INFORMATION

This application claims the benefit of U.S. Provisional Application No. 60/326,364 on Oct. 1, 2001.

FIELD OF THE INVENTION

The field of this invention relates to expansion of tubulars into other tubulars downhole or in open hole using liners, screens or tubing, both as a method and the specific equipment, which can be used to accomplish the method.

BACKGROUND OF THE INVENTION

In the past, tubulars have been expanded into casing for the purposes of patching broken casing or to hang a liner string. The casing, in different applications can have different wall thickness for a specific casing size, depending on the particular well requirements. Because of this, there is a problem with using a cone that is driven into a tubular to expand it into a given casing size. If the wedge or cone is a fixed dimension, it can hang up in heavy wall casing, where the need to expand the tubular is less than if the casing had a thinner wall.

In open hole the same problem can arise, as well as other problems. The amount of radial expansion is greater when expanding tubulars, liners, or screens in open hole. The linear footage of expansion is dramatically longer than when securing a liner to casing or patching casing with a tubular. The main purpose of an expanding open hole liner/screen is to get as close to the open hole borehole as possible, to both maximize the internal diameter (for subsequent operations) and to minimize, or eliminate, the annular area between the liner/screen to restrict axial annular flow. An open hole borehole however usually is not consistent in diameter and shape, and may consist of washed out areas as well as sections that may have partially collapsed inward. This makes the use of a fixed-diameter swedge cone somewhat impractical for open hole applications, as it does not have the capacity to adjust with irregularities in the borehole. A fixed-diameter swedge cannot compensate for enlarged holes to provide the borehole wall-to-liner contact, and may prohibit passage through the liner/screen when encountering a collapsed area in the borehole.

In the context of casing patches, a device depicted in U.S. Pat. No. 3,785,193 discloses the use of a mandrel with collets retained in a retracted position for run in. When a shear pin is broken at the desired location, a spring 49 pushes up-hole on the collets. The collets have radially extending pins 35,36, and 37 with end tapers that engage a longitudinally oriented driving pin 40, which is in turn biased by a stack of Bellville washers. In a tight spot during expansion, the collets 31 are pushed radially inwardly as are the radially extending pins. That radial movement is converted to longitudinal movement of the pin 40 against the force of the Bellville washers 43. This design presents several drawbacks. There is no way to retract the collets after the shear pin 51 is broken. This can create potential hang up problems on the removal operation after expansion. This design makes it difficult to adjust the preload on the Bellville washers. Finally, the applied force to keep the collets expanded from the Bellville washers must be transmitted at a right angle while relative movement is contemplated between the pins, such as 35 and the collets 31. This relative movement, in view of the part orientations can result in loads applied to the collets at a point other than directly behind the ridges 31*h*. If this happens, the collets can be deformed.

Yet other relevant art in the tubular expansion field comprises U.S. Pat. Nos. 3,358,760; 4,487,052; 4,602,495; 5,785,120; 6,012,523; 6,112,818.

Various embodiments of the present invention have been developed to address the shortcomings of the prior designs. In the case of hanging tubulars or liners in casing or patching casing, a flexible swedge has been developed having a movable cone biased by Bellville washers wherein the movable cone is in longitudinal alignment with the collets and ramps them radially when it is advanced longitudinally. This preferred embodiment incorporates a shear release to facilitate retraction of the collets for removal For open hole applications, a preferred embodiment has been developed to address the unique requirements of large radial expansions, which require high loads in confined spaces and for great distances. The preferred design addresses shortcomings in the fixed-diameter swedge design. The adjustable swedge cone allows and compensates for the irregularities in the open hole borehole. This is accomplished by using a collet-type swedge cone, which allows diametrical variance depending on the state of the dual cone assembly underneath (support structure for the collet). The drive system for the cone assembly is preferably nitrogen gas. A gas drive design is utilized due to the large diametrical range covered by the collet design. Mechanical drive mechanisms, while perhaps simpler, are impractical due to the relatively large axial displacement of the upper drive cone during normal operations of the device (i.e. a Belleville spring stack would be impractically long to allow for such high axial movement at the desired force for liner/screen expansion). A coiled spring would simply be too big in diameter for the available space and the force delivery requirement.

Prior to running in the hole, the multi-stage gas drive assembly is charged (allowing for thermal effects as the tool is run in the hole) to allow approximately 200,000# drive force against the swedge collet. Based on lab testing, this force is sufficient to swedge both solid and perforated (screen) base pipes. In this state the collet is expanded to a designed diameter to allow conformance with the borehole, even in a somewhat enlarged condition. As the swedge is pushed into the un-expanded liner/screen it expands the pipe outwards to the full diameter of the collet. If the hole is undersized or at gauge diameter (diameter drilled) the liner/screen will meet resistance when contacting the wellbore. To push the swedge through, the collet drives the upper cone upward against the nitrogen-charged cylinder assembly. As this occurs, the cone moving upwards allows the swedge collet to retract in diameter until it is allowed to pass through the expanded pipe. The high-pressure chambers of the gas assembly are also compressed, making the pressure increase, and thus the load on the swedge collet. Also, this same process occurs if a collapsed section of the borehole is encountered. The swedge collet simply retracts inward as increased force is applied against the gas-charged drive assembly. The gas-charged drive assembly, for example, will start to move upwards when about a 200,000# load is applied to the collet assembly, and will allow full retraction of the collet when about a 300,000# load is applied.

Another feature of the preferred design is that the gas-charged assembly is independent, and not sensitive to, the bottom hole pressure (hydrostatic). The design of the piston/cylinder assembly allows for force balance regarding hydrostatic pressure. The force generated by the assembly is purely dictated by the pressure differential between the low pressure (LP) and high pressure (HP) gas chambers in the assembly.

Also, a de-activation, or release, feature has been designed into the preferred embodiment of the tool to allow full retraction of the swedge cone in the event the assembly must be pulled form the well in an emergency situation (such as the bottom hole assembly becoming stuck), or once the total liner/screen has been expanded and the bottom hole assembly it to be pulled from the well. The tool in a released condition will not drag in the liner, and possibly get stuck, when pulled from the well. The release mechanism is preferably operated by applying internal pressure sufficient enough to shift the cylinder covering the locking dogs downward, allowing the dogs to become unsupported and free to disengage with the mandrel. This allows the lower stationary cone to move downwards away from the swedge collet, thus de-activating the collet from further expansion. Once de-activated, the tool is locked in this position until pulled out of the hole. These and other features of the invention will be apparent to those skilled in the art from a review of the detailed description of the preferred embodiments, which appears below.

SUMMARY OF THE INVENTION

Tools for expanding downhole tubulars into each other or in open hole are disclosed. One embodiment uses a movable cone biased by Bellville washers to move longitudinally against such bias and allow collets to move radially in or out to a predetermined maximum diameter. A release system allows collet retraction to avoid hang up on removal. In an alternate embodiment, more suitable for open hole applications, pressurized gas pushes a movable cone longitudinally against the collets. A stationary cone is on the opposite side of the collets from the movable cone. The collet rides out or in between the cones and raises the gas pressure when forced in. A pressure actuated release allows the lower cone to shift downwardly to allow the collets to retract for removal.

DETAILED DESCRIPTION OF THE PREFERRED EMBODIMENT

Figure 1:
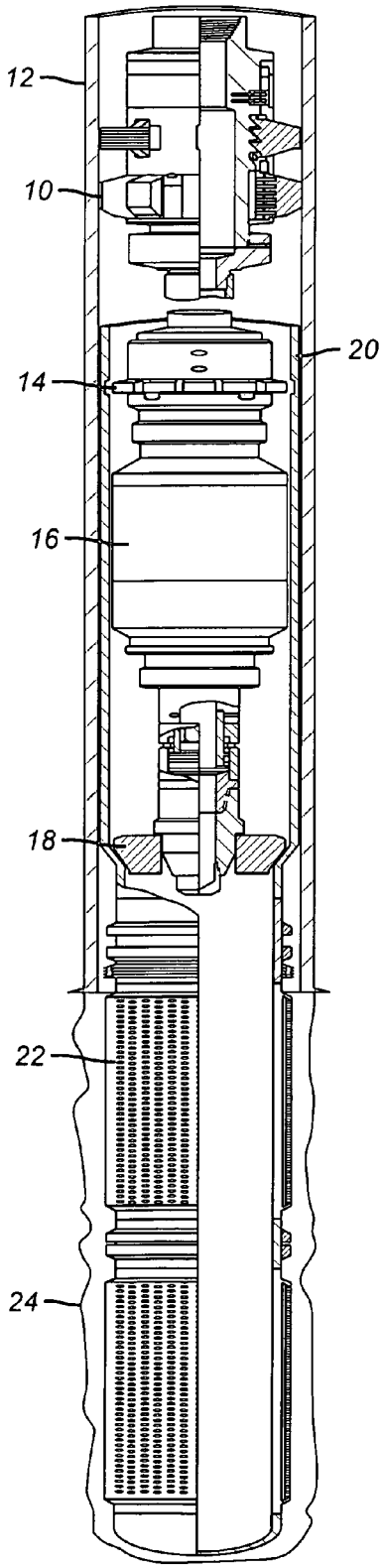
FIG. 1 is an elevation view, in section, of a one-trip assembly using the invention to expand a tubular downhole.

FIG. 1 generally shows the components of a one-trip system for expansion of tubulars downhole. An anchor 10 is set in casing 12. Below the anchor 10 is the liner running tool 14, which is in turn connected to the hydraulic drive assembly 16. The drive assembly 16 advances the swedge cone 18 to expand the blank pipe 20, with anchor 10 selectively engaged to the casing 12. Mounted below the blank pipe 20 can be screens 22 (shown prior to expansion), or a combination of screens with additional blank pipe between screen sections, in the open hole 24 section of the borehole. Generally, "tubulars" as used herein is intended to cover tubes, whether solid or having openings, liners, and screens.

Figure 2:
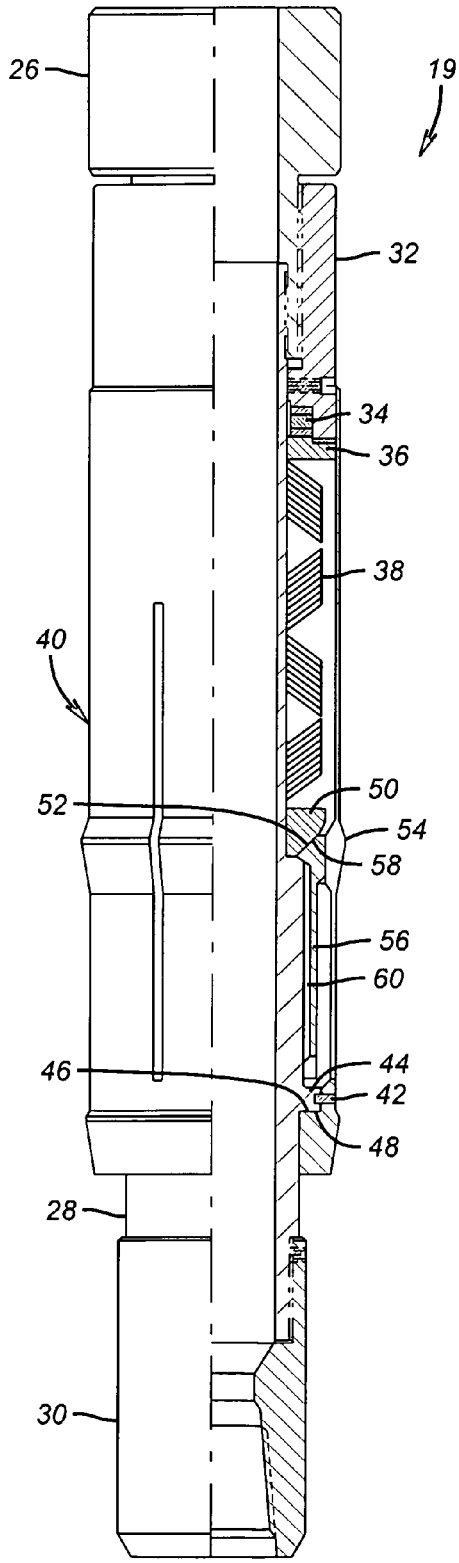
FIG. 2 is a longitudinal section through an embodiment using Bellville washers.

Referring to FIG. 2, an embodiment more particularly suited to expansion of blank pipe 20 in casing 12 is shown. Tool 19 has a top connection 26, which is attachable to the hydraulic drive assembly 16, such as shown schematically in FIG. 1. Top connection 26 is connected to body 28, which is in turn connected to bottom connection 30. Bottom connection 30 can hold other tools, such as additional expansion tools or tubulars. An adjustment ring 32 bears on thrust bearing 34, which in turn bears on cover 36 to allow a simple preload adjustment to Bellville washers 38, which encircle body 28, In the part section view of FIG. 2, the collets 40 are shown both externally and in section. Collets 40 are initially pinned to body 28 by a shear pin 42 at ring 44. Ring 44 has a downwardly facing shoulder 46 which engages upwardly facing shoulder 48 on collets 40 so that downward stroking of the tool 19 results in transmission of that force to the collets 40. The Bellville washers 38 bear on movable cone 50, which has a leading taper 52 to engage tapered surface 54 on inner collet 56, which is mounted inside collets 40 to bias them radially outwardly. Essentially, inner collet 56 is supported off ring 44 so that downward movement of movable cone 50 allows tapered surface 52 to slide along tapered surface 54 of inner collet 56 to force the thick portion 58 of collets 40 outwardly. If a tight spot is encountered the movements reverse and the result is compression of the stack of Bellville washers 38. The taper angle of surfaces 52 and 54 can be varied to change the amount of radial movement resulting from a given longitudinal displacement of the movable cone 50. A travel stop (not shown) can be provided on the body 28 to limit the amount of full outward movement of the collets 40. Thus, for a given casing size the tool 19 can accommodate different casing wall thickness and get the desired sealing contact from expansion through the compensation system provided by the Bellville washers 38. When the expansion is completed and an upward pull is applied, the shear pin 42 breaks to allow the thick portion 58 of collets 40 to move into recess 60 defined by inner collet 56. In this manner there will be no hang up as the tool 19 is extracted after being stroked down, as shown schematically in FIG. 1.

Those skilled in the art will appreciate that the thrust bearing 34 makes preload adjustment easy. The sliding relative motion between surfaces 52 and 54 caused by longitudinal movement of cone 50 with respect to stationary inner collet 56 is a more reliable way to transmit needed force with minimal wear on the key moving parts. The construction is far more durable for a longer useful life than the design shown in U.S. Pat. No. 3,785,193 with its radially extending pins, which could break or press on thin portions of the collet. The Bellville washers 38 can be replaced with other biasing techniques such as compressible fluid or a combination of liquid and gas in a chamber or locally developed hydraulic pressure or hydraulic pressure delivered from the surface or annulus pressure acting against an atmospheric chamber to name just a few variations. The inner collet can be optionally removed so that the cone 50 bears directly on a tapered surface on the thick portion 58 of the collets 40.

Figure 3:
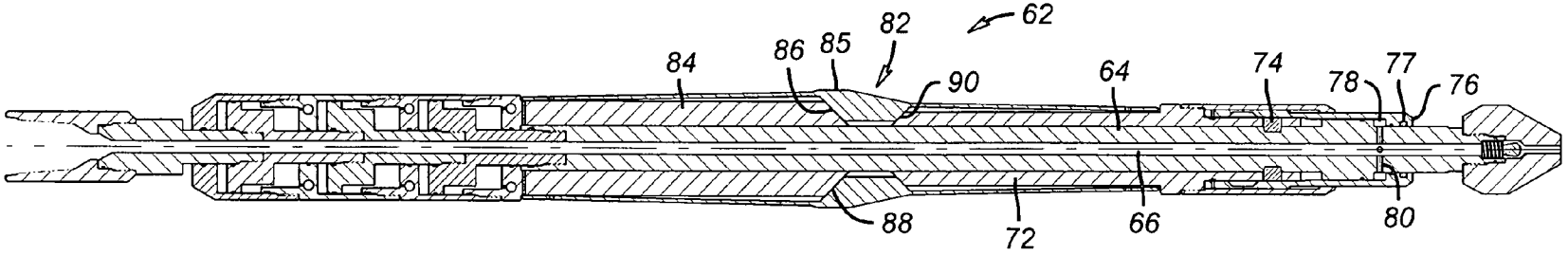
FIG. 3 is a section of the gas charged embodiment in the operating position.
Figure 4:
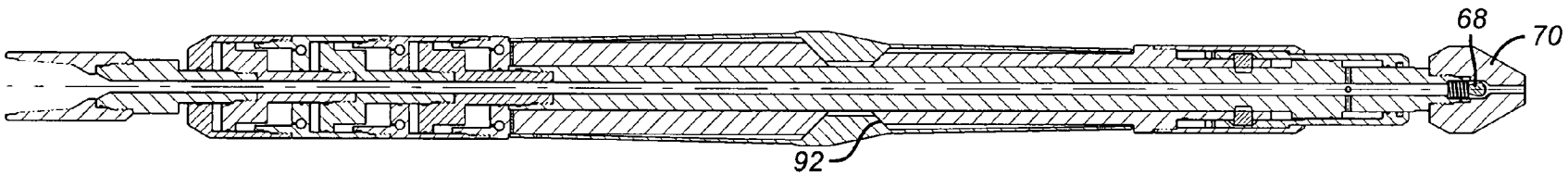
FIG. 4 is the view of FIG. 3 at the onset of release.
Figure 5:
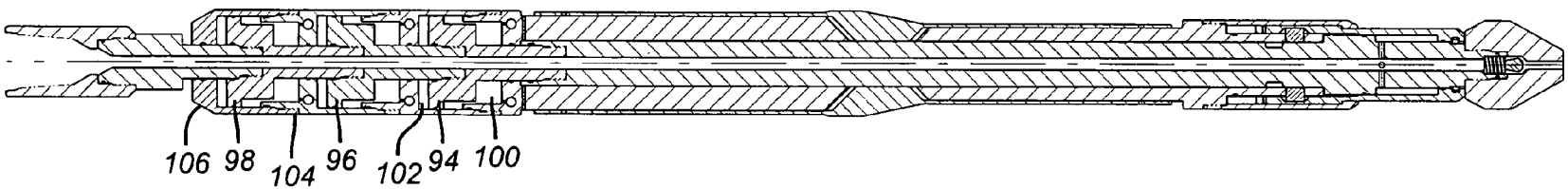
FIG. 5 is the view of FIG. 4 in the fully released position.

Referring now to FIG. 3 a somewhat different tool 62 is shown in the operating position. Again FIG. 1 schematically illustrates the hookup of tool 62 for expansion of tubulars, screens or the like downhole. A mandrel 64 has a central passage 66 with a ball check valve 68 at the lower end 70. Stationary cone 72 is held by dog 74 to mandrel 64. Dog 74 is retained by sleeve 76, which is held by pin 77 to mandrel 64. Applied pressure in passage 80, which connects central passage 66 with annular space 78, results in breaking the shear pin 77 to liberate the dogs 74 so that the stationary cone can move downwardly, when the expansion is done, to allow easy removal of the tool 62. A series of collets 82 extend over movable cone 84 and stationary cone 72 wherein the collets are preferably not fixed to either cone. Collets 82 have a thick portion 85, which features an inclined surface 86 that makes contact with inclined surface 88 on movable cone 84. Additionally, the thick portions 85 also have an inclined surface 90, which engages inclined surface 92 on stationary cone 72. When the movable cone moves down the thick portions 85 move outwardly as the tapered surface 88 pushed the thick portions 85 against the inclined surface 92 of stationary cone 72. The thick portions 85 are sandwiched and move radially in response to longitudinal movement of the movable cone 84. Pistons 94, 96, and 98 are connected together for force amplification to deliver the desired normal force of about 200,000 pounds on movable cone 84. These pistons are pressure balanced with respect to well hydrostatic pressure so the tool 62 is insensitive to depth. Each of these pistons has a high pressure charge in a zone, such as 100 on one side and a low pressure or atmospheric zone 102 on the opposite side so that a predetermined net force is communicated from the outer drive cylinder 104 to the movable cone 84. As a tight spot is reached in open hole, the movable cone responds to inward radial movement of the thick portions 85 by moving up, raising the pressure in zone 100 to generate as much as about 300,000 pounds or more. The top end 106 of the outer drive cylinder 104 presents an upward travel stop. After the tight spot is passed, the applied force from the movable cone 84 causes the collets 82 to more fully expand as before the tight spot was reached.

The purpose of ball check 68 is to allow wellbore pressure to equalize in passage 66 as the tool 62 is advanced by a hydraulic drive assembly, such as 16 shown in FIG. 1. By repeatedly releasing the anchor 10 and setting down weight and then re-anchoring, thousands of feet of tubulars or screens can be expanded in a single trip or if desired in multiple trips. Optionally, the hydraulic drive assembly can have a selectively open passage therethrough (not shown) such that fluid communication into passage 66 only occurs when the anchor 10 has been released and the running string (not shown) is picked up until the hydraulic valve assembly is fully extended. At that time pressure can build up in passage 66 because it is closed off by check valve 68. The release of dogs 74 allows the stationary cone 72 to come down to let the thick portions of collets 82 retract radially inwardly. Pressure release is preferred, particularly in deviated wellbores, where longitudinal or rotational movement of the string may not transmit the desired force to effectuate the release. In some applications, shear type release mechanisms can work well are contemplated as an alternative embodiment of the invention.

While the preferred embodiment has been described above, those skilled in the art will appreciate that other mechanisms are contemplated to accomplish the task of this invention, whose scope is delimited by the claims appended below, properly interpreted for their literal and equivalent scope.

We claim:

1. A tubular expansion apparatus, comprising:

a body having a longitudinal axis;

at least one collet mounted to said body and having a thickest portion designed for contact with the tubular;

an energy storage device on said body and making initial contact with said thickest portion of said collet, without longitudinal translation of said collet, to allow said thickest portion to expand the tubular and to move in a direction transverse to and toward said longitudinal axis upon encountering a predetermined resistance to expansion of the tubular.

2. The apparatus of claim 1, wherein:

said energy storage device comprises a longitudinally movable member having a first tapered surface;

said thickest portion of said collet having a second tapered surface facing said first tapered surface for contact therewith.

3. The apparatus of claim 2, wherein:

said second tapered surface is integral to said thickest portion of said collet.

4. The apparatus of claim 1, wherein:

said body is selectively movable longitudinally with respect to said collet to allow said thickest portion to retract into a recessed portion of said body after the tubular has been expanded.

5. The apparatus of claim 1, wherein:

said body comprises a projection to contact said collet for tandem movement when the tubular is expanded by moving said body in a first direction;

said projection moving with respect to said collet when said body is moved in a second direction opposite said first direction to present a recess adjacent said thickest portion to allow said body to be removed from the tubular.

6. The apparatus of claim 1, wherein:

the amount of force delivered to said thickest portion of said collet by said energy storage device is externally adjustable.

7. The apparatus of claim 6, wherein:

said energy storage device comprises at least one spring and said external adjustment is accomplished by turning a nut against said spring.

8. A tubular expansion apparatus, comprising:

a body having a longitudinal axis;

at least one collet mounted to said body and having a thickest portion designed for contact with the tubular;

an energy storage device on said body and making initial contact with said thickest portion of said collet, without longitudinal translation of said collet, to allow said thickest portion to expand the tubular and to move in a direction transverse to and toward said longitudinal axis upon encountering a predetermined resistance to expansion of the tubular;

said energy storage device comprises a longitudinally movable member having a first tapered surface;

a secondary collet is disposed between said collet and said first tapered surface, said secondary collet comprising a second tapered surface facing said first tapered surface for contact therewith.

9. The apparatus of claim 8, wherein:

said secondary collet is restrained from moving longitudinally with respect to said body.

10. The apparatus of claim 8, wherein:

said secondary collet contacts said thickest portion of said collet along an annular surface substantially parallel to said longitudinal axis.

11. A tubular expansion apparatus, comprising:

a body having a longitudinal axis;

at least one collet mounted to said body and having a thickest portion designed for contact with the tubular;

an energy storage device on said body and making initial contact with said thickest portion of said collet, without longitudinal translation of said collet, to allow said thickest portion to expand the tubular and to move in a direction transverse to and toward said longitudinal axis upon encountering a predetermined resistance to expansion of the tubular;

said body comprises a projection to contact said collet for tandem movement when the tubular is expanded by moving said body in a first direction;

said projection moving with respect to said collet when said body is moved in a second direction opposite said first direction to present a recess adjacent said thickest portion to allow said body to be removed from the tubular;

movement of said body in said second direction disables said energy storage device from contact with said thickest portion of said collet.

12. A tubular expansion apparatus, comprising:

a body having a longitudinal axis;

at least one collet mounted to said body and having a thickest portion designed for contact with the tubular;

an energy storage device on said body and making initial contact with said thickest portion of said collet, without longitudinal translation of said collet, to allow said thickest portion to expand the tubular and to move in a direction transverse to and toward said longitudinal axis upon encountering a predetermined resistance to expansion of the tubular;

the amount of force delivered to said thickest portion of said collet by said energy storage device is externally adjustable;

said energy storage device comprises at least one spring and said external adjustment is accomplished by turning a nut against said spring;

a thrust washer is located between said nut and said at least one spring to facilitate turning said nut.

13. The apparatus of claim 12, wherein:

said at least one spring comprises a stack of Belleville washers, or a coil spring or a source of fluid pressure.

14. An apparatus for expanding tubulars, comprising:

a body having a longitudinal axis;

at least one collet extends over said body but not fixed thereto, said collet said body having a thickest portion designed to contact the tubular, said thickest portion formed having a first tapered surface;

a first cone having a second tapered surface and biased longitudinally to move said second tapered surface against said first tapered surface:

whereupon when said body is advanced in said tubular to expand it, said first cone is movable in opposed directions to allow said collet to move in opposed directions.

* * * * *